US006722321B2

(12) United States Patent
Kim

(10) Patent No.: US 6,722,321 B2
(45) Date of Patent: Apr. 20, 2004

(54) ROTARY ENGINE

(76) Inventor: Dong-Hyun Kim, 517-15, Yicheon-dong, Nam-gu, Daegu (KR)

( * ) Notice: Subject to any disclaimer, the term of this patent is extended or adjusted under 35 U.S.C. 154(b) by 0 days.

(21) Appl. No.: 10/275,177

(22) PCT Filed: May 16, 2002

(86) PCT No.: PCT/KR02/00921

§ 371 (c)(1),
(2), (4) Date: Nov. 4, 2002

(65) Prior Publication Data

US 2003/0106504 A1 Jun. 12, 2003

(51) Int. Cl.[7] ..... F02B 57/00

(52) U.S. Cl. ..... 123/43 R; 123/241; 123/243; 418/260

(58) Field of Search ..... 123/241, 43 R, 123/243; 418/260

(56) References Cited

U.S. PATENT DOCUMENTS

| | | | | | |
|---|---|---|---|---|---|
| 4,389,173 | A | * | 6/1983 | Kite | 418/260 |
| 4,451,215 | A | * | 5/1984 | Winkler et al. | 418/260 |
| 6,164,263 | A | | 12/2000 | Saint-Hilaire et al. | |
| 6,457,450 | B1 | * | 10/2002 | Luzhkov | 123/241 |

FOREIGN PATENT DOCUMENTS

| | | | | | |
|---|---|---|---|---|---|
| EP | 103985 | A | * | 3/1984 | 123/241 |
| FR | 1255205 | | * | 1/1961 | 123/241 |
| FR | 2744172 | A1 | * | 8/1997 | F02B/57/00 |
| IT | 248528 | | * | 2/1925 | 418/260 |
| JP | 57-143132 | A | | 9/1982 | |
| JP | 59-119027 | A | | 7/1984 | |
| JP | 59-224421 | A | | 12/1984 | |

* cited by examiner

*Primary Examiner*—Thomas Denion
*Assistant Examiner*—Thai-Ba Trieu
(74) *Attorney, Agent, or Firm*—Birch, Stewart, Kolasch & Birch, LLP

(57) ABSTRACT

A rotary engine including a cylinder shaped housing, a rotation body rotating in the housing, an oval guide part located at the center of the rotation body being prominently formed from the cylinder shaped housing. A axis of rotation being formed in monolithic structure with the rotation body penetrated through the cylinder shaped housing and the oval guide part, an induction hole, an exhaust hole, and an ignition plug or a fuel supply device in selection up to the engines. At least one of operation rooms being furnished with air hole and located in the rotation body, and each of pistons being at one side of the operation rooms to be rotated, wherein a tail and a front of said pistons circumscribe with the oval guide part and a guide bar inscribing with a guide surface of the cylinder shaped housing through a guide roller at a shaft stick connecting said pistons.

4 Claims, 6 Drawing Sheets

ROTARY ENGINE

BACKGROUND OF THE INVENTION

This application is the national phase under 35 U.S.C. § 371 of PCT International Application No. PCT/KR02/00921 which has an International filing date of May 16, 2002, which designated the United States of America.

TECHNICAL FIELD

The present invention is directed to a Rotary Engine as an internal combustion engine.

BACKGROUND ART

Ordinary rotary engines are designed to work four step strokes by providing a triangular rotor rotating eccentrically within a housing. To make such a housing and rotor is difficult due to their geometrical structure, and the rotary friction of the rotor is high during operation. Accordingly, the abrasion ratio of the rotor is high, and this is accompanied by many problems such as the production of smoke due to burning as a result of lubricating oil which is mixed with the fuel, as there is no independent lubricating function. Therefore, the rotary engine has not yet been actively utilized, even though it has many merits because it is small and light compared with the other types of reciprocating engines of the same power.

DISCLOSURE OF THE INVENTION

To solve the above problems according to the present invention, 4 strokes of the engine is performed by the piston operation, compressing and expanding the operation room by its sliding moving while the piston of the rotation body, which is rotating the axis of rotation in the cylinder type housing circumscribes with an oval guide part. This oval guide part is prominently formed from the housing toward the central part of the rotation body.

Also, in the piston of the rotation body, the shaft stick is connected to the guide bar which has a guide roller, and the guide roller is internally contacted with the oval guide surface of the housing. By this structure, every compression and/or expansion of the operation room in each strokes can be smoothly accomplished even with the operation of the centrifugal force.

During the process of the 4 strokes, the lubricating oil is introduced through the lubricating oil supply route and supply hole which are formed in the axis of rotation, and is removed through the discharge route and discharge hole to be circulated. Then the induction hole which intakes the fuel, the exhaust hole which discharges the exhausting gas, and the operation room are shut tight by an oil seal so that the flow of the lubricating oil into the operation room may be cut off during lubrication.

Consequently, according to the present invention, the composition is comparatively simple, and manufacturing is easy. The operation of the rotational body and the piston is supple and smoothly accomplished. Thus, vibrational noise and the abrasion ratio of the piston can be reduced and the smoke reduced due to its independent lubricating function.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
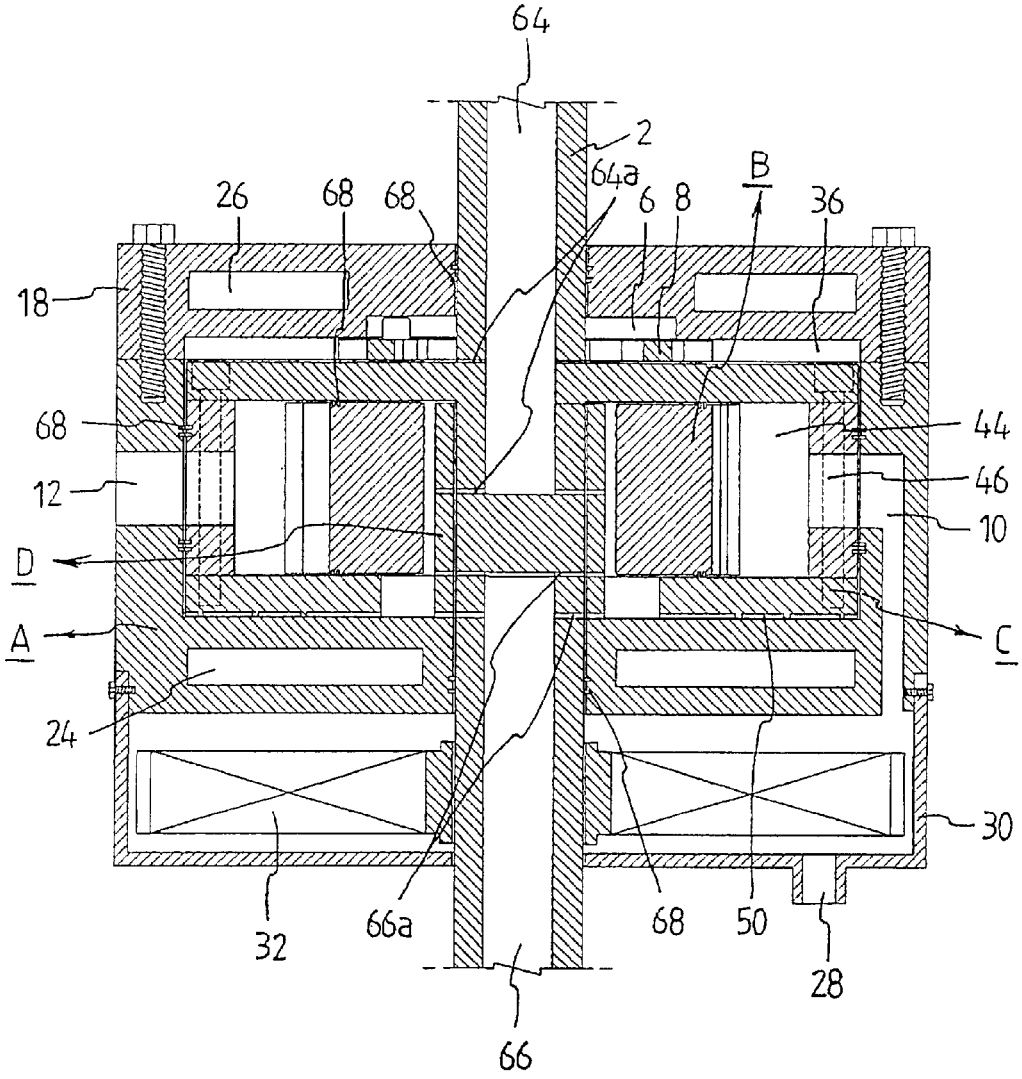
FIG. 1 is side cut view of the present invention.
Figure 2:
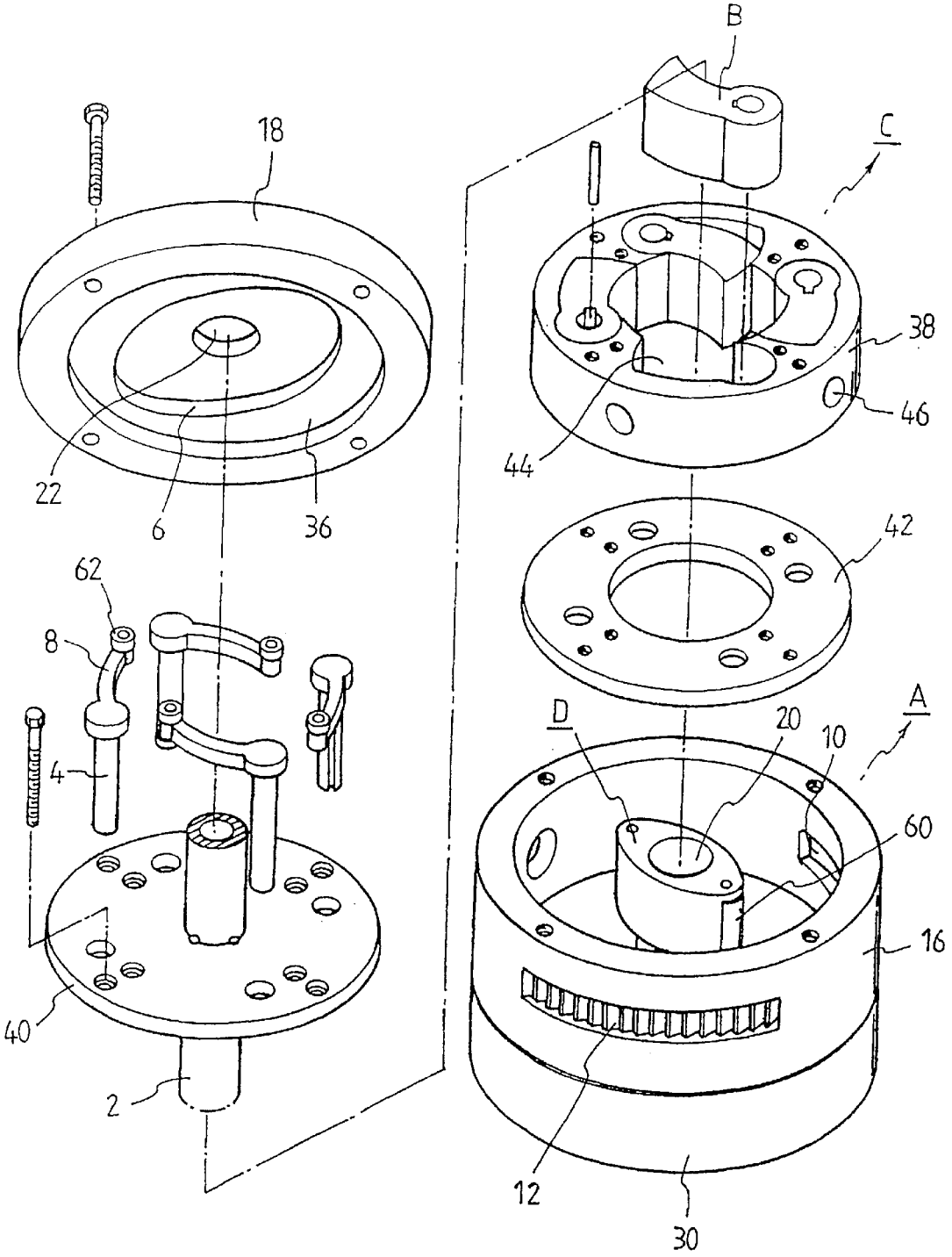
FIG. 2 is detailed drawing of the present invention.

The present invention, as shown in the FIG. 1 and 2, is composed of a cylinder type housing(A), a rotational body (C), an oval guide part(D), and a guide bar. In this construction, the rotational body(C), in which more than one(l) piston(B) is installed, is rotating around the axis of ration(2) in the housing(A). An oval guide bar(D) is prominently formed at the internal surface of the housing(A) toward the central part of the rotation body(C). Also, the guide bar(8) is formed at the shaft stick(4) which is connected with the piston(B) and guided by the guide surface(6) of the housing(A).

The induction hole(10) for fuel introduction and the exhaust hole(12) for gas exhausting are formed at the both sides of the housing (A). Between them, the ignition plug (14) or the fuel supply device is alternatively installed by the particular engine(gasoline engine or diesel engine). The body(16) in which an oval guide part(D) is prominently formed at the internal wall of the housing(A) and a lid(18) which is connected by bolts with the body(16) are provided in the internal space of the housing(A), and a shaft hole(20) (22) through which an axis of rotation(2) extends is formed at the guide part(D) and lid(18) of the body(16).

The body(16) and lid(18), which defines housing(A), forms cooling rooms(24) (26) which are filled with cooling liquid. At the bottom of the body(16), the cover(30) which has the fuel inlet pipe(28) is connected by bolts. In the cover(30), the fuel pressure apparatus(32) is set, and the fuel pressure apparatus(32) in the turbine pattern is fixed on the axis of rotation(2).

Figure 3:
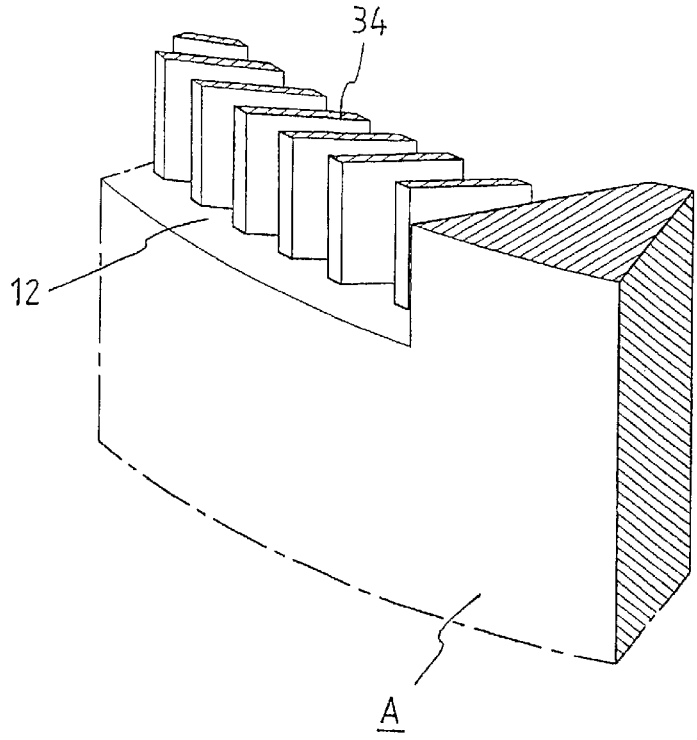
FIG. 3 is partial view of the exhaust hole utilized in the present invention.

In the exhaust hole(12), which is formed at the body(16) of the housing(A), several inclined boards(34) are set close together toward the turning direction of the rotation body(C) to increase the driving force when exhausting, as shown in FIG. 3.

The oval guide part(D), prominently formed at the internal wall of the body(16), has the shortest bottom point of the stroke and the longest peak point of the stroke from the central point of the shaft hole(22), and is located in the center of the rotational body(C).

The operation space(36) and oval guide surface(6) are formed at the internal side of the lid(18), and the operational space helps the free operation of the guide bar(8), and the oval guide surface is engraved at the operation room. The oval guide surface (6) maintains an elliptical orbit in which the piston(B) can keep the circumscribed position with the guide part(D) through the inscribed guide bar(8).

The rotational body(C) is composed of the cylinder shaped body(38) and the airtight board(40) (42) which are joined by bolts at both sides of the body(38), and the axis of rotation(2) is formed in one body with one of the airtight boards(40).

More than one operation room(44) is formed in the body(38) of the rotation body(C), and in each operational room, an air hole(46) is formed, which intakes the fuel and exhausts the gas after combustion. The air hole(46) carries out the function of the operation room(44) as a part of the operation room(44) as well as intakes fuel and exhausts gas.

Figure 4:
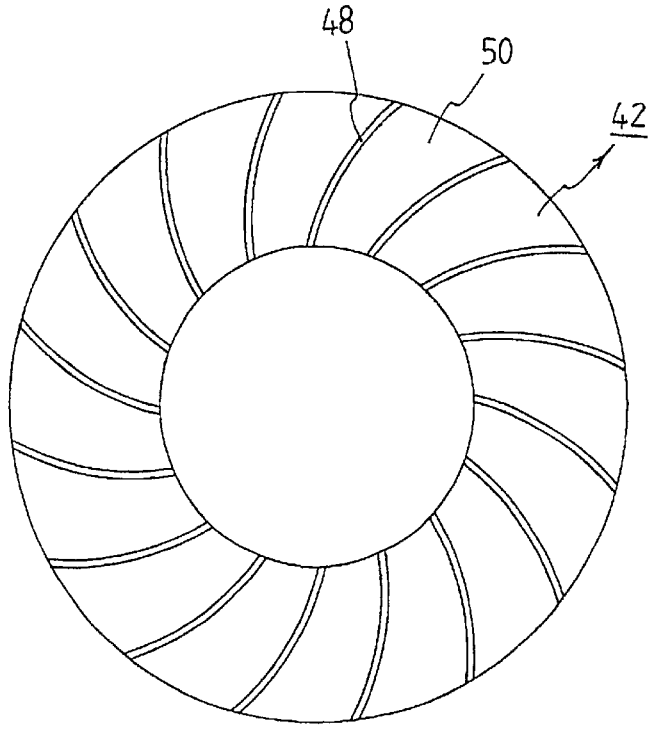
FIG. 4 is structural drawing of the oil groove for the discharge of lubricating oil in the bottom of the rotational body, according to the present invention.

At the outer surface of the other airtight board(42) of the rotation body(C) as shown in FIG. 4, many of the guide prominences(48) are radially formed, which in turn form the oil route(50), which promotes exhausting of lubricating oil.

Figure 5:
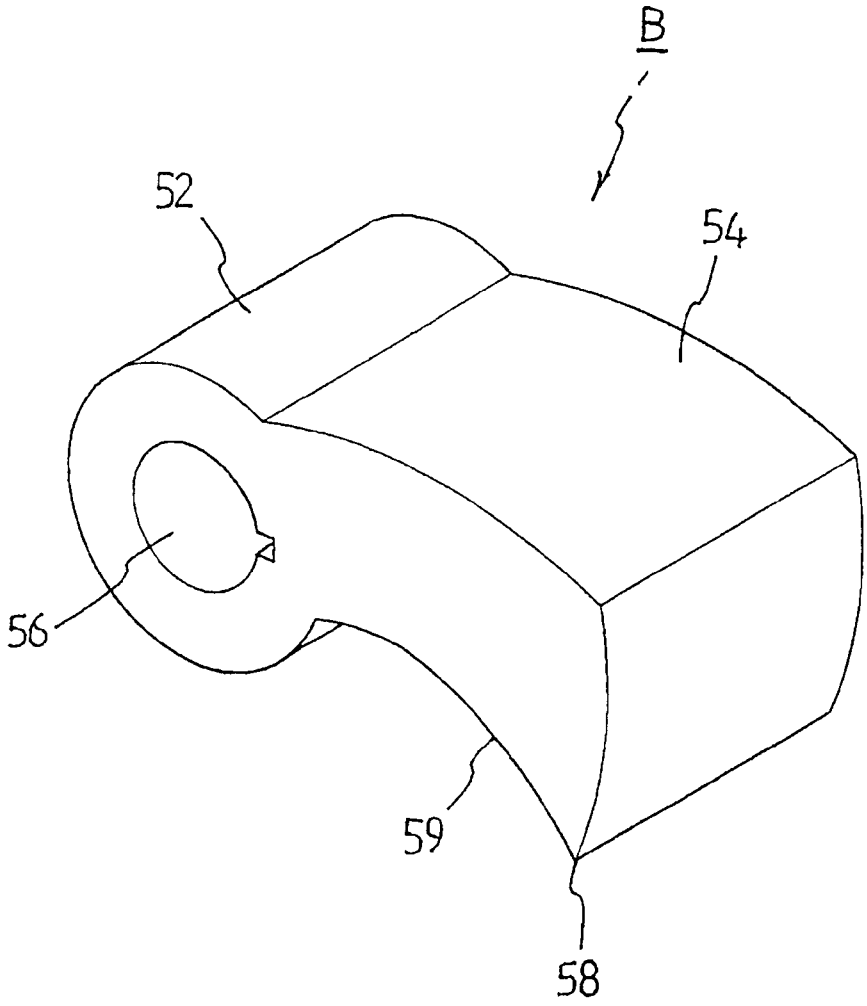
FIG. 5 is view of the piston used in the present invention.
Figure 6:
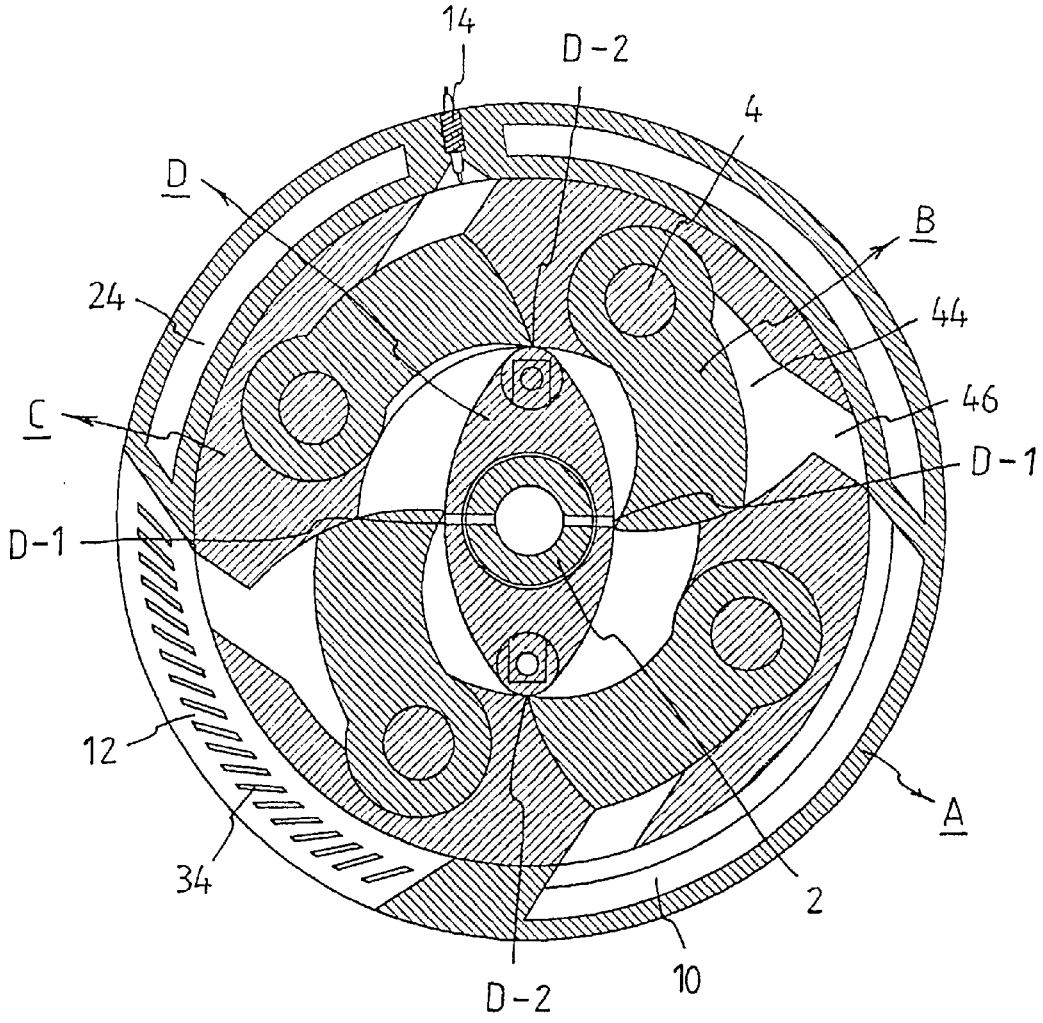
FIG. 6 is plane view of the present invention.

The piston(B) is installed in each operation room(44) of the rotation body(C) as shown in FIG. 5, and is constructed of a round head(52), and body(54) which is formed as a curve from one side of the head(52) toward the inner side. This piston(B) is connected to the rotational body(C) with the shaft stick(4) through the connecting hole(56) of the head(52), and the tail(58) of the edge of body(38) and the front(59) are circumscribed to the oval guide part(D).

It is desirable to install the guide roller(60) at the tail(58) of the above piston(B) and the peak point of stroke(D-2) to decrease friction when rotating.

The shaft hole(4) which connects the piston(B) is formed in monolithic organization with the piston(B) through the connecting hole(56) from outside of the airtight board(40) in one side of the rotation body(C), and the guide bar(8) is also formed in monolithic structure with the edge of the shaft hole(4) outwardly exposed. The edge of the guide bar(8) forms guide roller(60) (62) and is contacted internally with the guide surface(6) of the housing(A) through the guide roller(62).

The axis of rotation(2) is formed in monolithic structure at the other side of the airtight board(40) of the rotation body(C), and is provided with lubricating oil supply route (64) and lubricating oil discharge route(66) at its inside. The lubricating oil supply route(64) is connected with the inner part of the engine by the supply holes(64*a*) and the lubricating oil discharge route(66) is connected with the inner part of the engine by the discharge holes(66*a*).

Oil seal(68) is formed between the housing(A) and the rotation body(C), and between the rotation body(C) and piston(B), respectively. The oil seal(68) prevents lubricating oil from flowing into the operating room(44), the air hole (46), the induction hole(10), and the exhaust hole(12).

The ignition plug(14) of the present invention is located at the ignition point when the piston(B) passes by the peak point of stroke(D-2) of the guide part(D). If a fuel supply device is installed at the ignition point instead of the ignition plug(14), this is satisfactory for diesel engine.

The piston(B) contracts and expands the volume of operation room(44) when passing by the bottom point of stroke (D-1) and the peak point of stroke(D-2) of the oval guide part(D) because the tail(58) circumscribes the guide part(D) and the guide roller(62) of the guide bar(8), which is set up at the shaft stick(4), inscribes the guide surface(6) of the housing(A) when the rotation body(C) rotates.

At this time, the tail(58) of the piston(B) begins to rotate toward the center of the rotation body(C) around the shaft stick(4) by moving to the bottom point of stroke(D-1) passing by the peak point of stroke(D-2) of the guide part(D) from the time that the air hole(46) of the operation room(44) meets the induction hole(10). According to the above rotation, the operation room(44) contracts to the minimum size and then is expanded, more and more. The fuel, which flows into the fuel inflow pipe(28) by injection at the maximum expansion of the operation room(44), is strongly induced into the operation room(44) throughout the induction hole(10), as pressurized by the fuel pressure apparatus (32).

This kind of induction operation continues while the air hole(46) of the operation room(44) passes by the induction hole(10) of the housing(A). In this stroke, even though the centrifugal force occurs to the piston(B) by the rotation of rotation body(C), the strokes are normally performed because the guide bar(8), which is connected to the shaft stick(4), inscribes the oval guide surface(6) of the housing (A) through the guide roller(62).

The piston(B) circumscribes with the guide part(D), and by sliding motion contracts and/or expands the operation room(44). The tail(58) cannot maintain sliding contact with the guide part(D), especially in the inhaling course with no affect of the out force because there is a regular centrifugal force due to the rotation of the rotation body(C).

Figure 7:
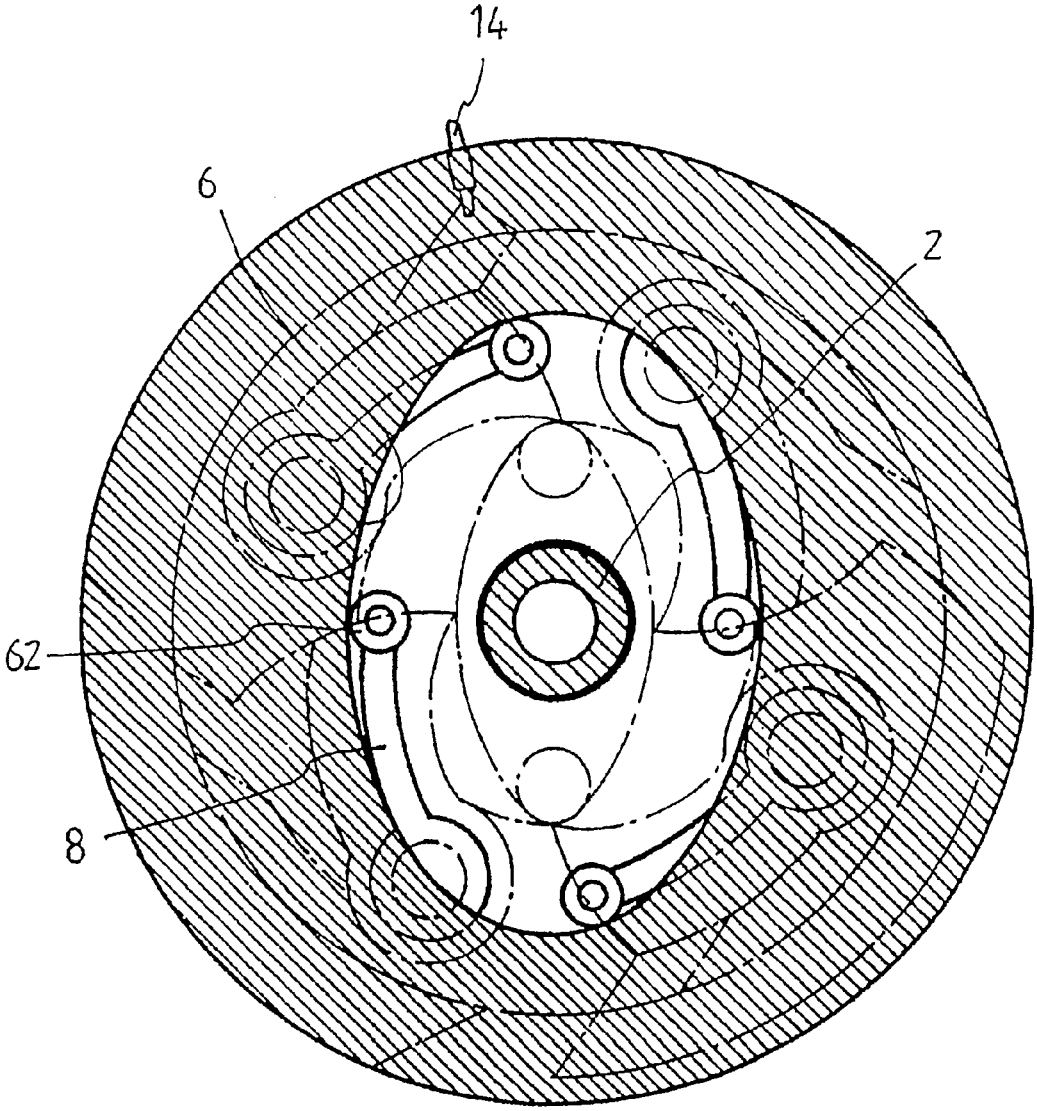
FIG. 7 is plane view which shows the working motion of the guide bar according to the present invention.

But, as shown in the FIG. 7, the tail(58) of the piston(B) always circumscribes the guide part(D) without any affect of the centrifugal force because the tail(58) of the piston(B) always circumscribes the guide part(D) and the guide bar(8) inscribes the guide surface(6) of the housing(A) through the guide roller(62).

After the air hole(46) of the rotation body(C) passes by the induction hole(10) of the housing(A), the operation room(44) and air hole(46) are hermetically closed by oil seals(68) which surround the inner surface of the housing (A), the operation room(44), and the air hole(46).

Thus, an induction stroke is completed.

When the induction stroke is completed, the tail(58) of the piston(B) moves to the peak point of stroke(D-2) passing by the bottom point of stroke(D-1) of the guide part(D), and so, the minimized operation room(44) at the bottom point of stroke is contracted, step-by-step to compress the fuel.

If the tail(58) of the piston(B) reaches the peak point of the stroke, the volume of the operation room(44) is minimized and the fuel is maximally compressed, and the compression stroke is completed.

When the ignition plug(14) is fired at maximum compression, the fuel is burned to begin the expansion stroke. As the expansion force pulls the back of the piston (B), the rotation body(C) receives rotation power to rotate in the opposite direction of the clock hand.

At this time, the tail(58) of the piston(B) moves to the bottom point of stroke(D-1), passing by the peak point of stroke(D-2), and the operation room(44) is gradually expanded. By the continuation of the rotation, when the air hole(46) of the operation room(44) meets the exhaust hole (12), the expansion stroke is completed and exhaust stroke is begun.

When the exhaust stroke begins, the tail(58) of the piston (B) again moves to the peak point of stroke(D-2) passing by the bottom point of stroke(D-1), and accordingly the minimized operation room(44) gradually contracts and the exhaust stroke rapidly proceeds.

In the exhaust stroke, many slanted boards are formed in the exhaust hole(12) as shown in FIG. 3, and the driving force is added by the operation of the slant boards(34).

When the air hole(46) of the operation room(44) completely passes by the exhaust hole(12), the exhaust stroke is completed. At this time, the tail(58) of the piston(B) again moves to the bottom point of stroke(D-1) passing by the peak point of stroke(D-2), and the minimized operation room(44) is gradually expanded passing by the induction hole(10), and the induction stroke which draws in the fuel again begins to repeat its stroke.

During these 4 step strokes, the lubricating oil, which is supplied through the lubricating oil supply route(64) of the axis of rotation(2), is induced between the housing(A) and rotation body(C), between the rotation body(C) and piston (B), and between the axis of rotation(2) and housing(A) and/or the guide part(D), evenly distributed through the supply holes(64*a*) to enable a smooth rotation. Thus, the circulating operation of the lubricating oil, in which the lubricating oil is exhausted through the supply hole(66*a*) lubricating oil discharge route(66), is performed.

There is no worry about generation of smoke caused by the combustion of the lubricating oil because the induction hole(10), exhaust hole(12), operation room(44), and air hole(46) are hermetically closed by oil seal(68) to prevent the inflow of lubricating oil thereinto.

When the lubricating oil is exhausted, the lubricating oil rapidly moves to the central part through the oil route(50) in the gabs of the radial guide prominences(48) by the rotation of the rotation body(C), and the lubricating operation is smoothly performed.

According to the present invention, 4 strokes are performed by the piston(B) of the rotation body(C) by circumscribing with the guide part(D) and by slidably moving in the housing(A). Therefore, the present invention is very effective in easy of manufacturing due to a comparatively simple composition, smooth and tender operation with less rotation friction, less noise, a low abrasion ratio of the piston(B), and no concern about smoke generation from the lubricating oil due to the independent lubricating function, compared with the ordinary rotary engines in which the 4 strokes are performed by the eccentric rotation of the triangle rotor.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A rotary engine comprising:

a cylinder shaped housing;

a rotation body rotating in the housing;

an oval guide part located at the center of the rotation body being prominently formed from the cylinder shaped housing;

a axis of rotation being formed in monolithic structure with the rotation body penetrated through the cylinder shaped housing and the oval guide part;

an induction hole;

an exhaust hole;

an ignition plug or a fuel supply device in selection up to the engines;

at least one of operation rooms being furnished with air hole and located in the rotation body, and each of pistons being at one side of the operation rooms to be rotated, wherein a tail and a front of said pistons circumscribe with the oval guide part; and a guide bar inscribing with a guide surface of the cylinder shaped housing through a guide roller at a shaft stick connecting said pistons.

2. The rotary engine according to claim 1, further comprising a lubricating oil supply route at the axis of rotation of the rotation body, a supply hole, a lubricating oil discharge route, a discharge hole, and in which all around the operation room, and the air hole are hermetically closed by the oil seal.

3. The rotary engine according to claim 1, wherein a cover is formed with a fuel inflow pipe at one side of the cylinder shaped housing, and wherein an installed fuel pressure apparatus is connected at and fixed to the axis of rotation.

4. The rotary engine according to claim 1, wherein guide prominences radially form oil routes around and direct to one side on the rotation body.

* * * * *